US005809949A

United States Patent [19]

Duret

[11] Patent Number: 5,809,949

[45] Date of Patent: Sep. 22, 1998

[54] TWO-STROKE ENGINE WITH IMPROVED INJECTION DEVICE AND ASSOCIATED INJECTION PROCESS

[75] Inventor: Pierre Duret, Sartrouville, France

[73] Assignee: Institut Francais du Petrole, Rueil Malmaison, France

[21] Appl. No.: 793,847

[22] PCT Filed: Jun. 28, 1995

[86] PCT No.: PCT/FR95/00866

§ 371 Date: Mar. 10, 1997

§ 102(e) Date: Mar. 10, 1997

[87] PCT Pub. No.: WO96/07817

PCT Pub. Date: Mar. 14, 1996

[30] Foreign Application Priority Data

Sep. 9, 1994 [FR] France ..... 94/10782

[51] Int. Cl.[6] ..... F02M 67/00; F02M 69/10

[52] U.S. Cl. ..... 123/65 VB; 123/73 B

[58] Field of Search ..... 123/65 VB, 65 V, 123/65 R, 73 B, 65 P

[56] References Cited

U.S. PATENT DOCUMENTS

| | | | |
|---|---|---|---|
| 4,619,228 | 10/1986 | Liu | 123/182 |
| 5,005,537 | 4/1991 | Maissant | 123/65 VB |
| 5,586,523 | 12/1996 | Kawahara et al. | 123/65 VB |

FOREIGN PATENT DOCUMENTS

| | | |
|---|---|---|
| 2627810 | 9/1989 | France . |
| 2656656 | 7/1991 | France . |
| 4000864 | 7/1991 | Germany . |
| A 55-137313 | 10/1980 | Japan . |
| A 57-091317 | 6/1982 | Japan . |
| WO 96/07817 | 3/1996 | WIPO . |

*Primary Examiner*—David A. Okonsky
*Attorney, Agent, or Firm*—Antonelli, Terry, Stout, & Kraus, LLP

[57] ABSTRACT

The present invention relates to a two-stroke engine comprising at least:

a cylinder (111) in which a piston (112) moves and one end of which communicates with a pump crankcase (115) crossed through by the crankshaft (114) of the engine, a capacity under pressure (87) opening at one end into the combustion chamber (113) of the cylinder (111), at least one valve (86) ensuring an intermittent sealing between the chamber (113) and the capacity (87), a means (88) intended for carburetting the gas passing in said capacity (87), a means for controlling the opening of said valve (86) comprising a supple membrane (89) separating two chambers (95*a*, 95*b*) and connected to the rod of the valve.

The engine according to the invention further comprises a liking means (92) between one (95*b*) of said chambers and the pump crankcase (115) of said cylinder, allowing notably the opening of the valve (86) to be activated as soon as possible when the pressure $P_B$ in the chamber (95*b*) becomes lower than the pressure $P_S$ in said capacity (87).

12 Claims, 3 Drawing Sheets

TWO-STROKE ENGINE WITH IMPROVED INJECTION DEVICE AND ASSOCIATED INJECTION PROCESS

FIELD OF THE INVENTION

The present invention relates to the field of two-stroke engines with controlled air-blast injection.

More precisely, the present invention relates to the operation and to the control of the air-blast injection of fuel in single-cylinder or multi-cylinder two-stroke engines.

BACKGROUND OF THE INVENTION

A conventional way to control air-blast injection consists in connecting the valves to a camshaft. This purely mechanical solution does not provide much flexibility since each cam imposes a precise motion of a valve and, besides, the camshaft supporting several cams, it is a given general motion that is imposed from the start by all the cams. This technology therefore generates a general control common to all the valves of the camshaft. Adjustment is difficult and a problem on one of the cams and/or of the valves can have repercussions on all the other parts at work.

More flexible control systems are known, which are notably based on pressure variations between different chambers co-operating with the motion of the valve.

French patents FR-2,656,653 and FR-2,656,656 thus describe multi-cylinder two-stroke engines in which the air-blast fuel injection is achieved by means of pressure differences between different chambers. This prior art specifically relates to engines having several cylinders since the pressure differences are generated by the angular offset between the cycles of the different cylinders.

SUMMARY OF THE INVENTION

The object of the present invention is to simplify this technology and above all to allow its application to single-cylinder engines, which the above-cited prior art does not allow.

The present invention can nevertheless apply to multi-cylinder engines but, unlike the prior art, in this case the injection works independently in each cylinder. In other words, according to the present invention, each cylinder works, with regard to its air-blast injection, in an independent and autonomous way, with no particular connections between the cylinders. A multi-cylinder engine according to the invention must therefore be considered as an engine having juxtaposed autonomous cylinders.

Generally speaking, the object of the invention consists in making use of the different pressure variations inherent in the running of a cylinder in order to actuate automatically a device intended for air-blast fuel injection into this cylinder. In other words, this consists, according to the invention, in controlling the opening and the closing of a valve automatically at each engine revolution, at precise and predetermined times, without requiring a power-driven means such as a camshaft.

As a result, the adjustment and the control of the injection according to the invention is individual, at the level of each cylinder, which simplifies the conventional multi-cylinder solution.

The present invention thus relates to a two-stroke engine comprising at least:

- a cylinder in which a piston moves and one end of which communicates with a pump crankcase crossed through by the crankshaft of the engine,

- a capacity under pressure opening at one end into the combustion chamber of the cylinder, at least one valve ensuring an intermittent sealing between the chamber and the capacity,
- a means intended for carburetting the gas passing in said capacity,
- a means for controlling the opening of said valve comprising a supple membrane separating two chambers and connected to the rod of the valve.

The engine according to the invention further comprises:

- a linking means between one of said chambers and the pump crankcase of said cylinder, allowing notably the opening of the valve to be activated as soon as possible when the pressure $P_B$ in the chamber becomes lower than the pressure $P_S$ in said capacity.

Preferably, the capacity opens by its other end into an opening of the pump crankcase, a means for controlling said opening being also provided.

Specifically, the engine according to the invention can also comprise a means intended for sealing intermittently said linking means so as to delay the pressure drop in the linking means, i.e. the opening of the valve.

More precisely, said intermittent sealing means can comprise a flange located in the pump crankcase, linked in rotation to the engine crankshaft and comprising at least a peripheral recess.

According to one of its characteristics, the engine can also comprise control means linked to the closing of the valve.

Said control means advantageously comprise a means of connection between the other one of said chambers and said pump crankcase, said means being so laid out that it is intermittently sealed on the pump crankcase side, said means allowing alternately to amplify the opening of the valve and to help towards its closing.

According to an embodiment of the invention, said connection means opens by an opening into the lower part of the cylinder so as to be alternately covered and uncovered by the piston.

According to the other embodiment of the invention, the intermittent sealing of the connection means is achieved by a specific flange linked to the crankshaft.

Without departing from the scope of the invention, the engine can also comprise an elastic return element for replacing the valve on its seat, which co-operates with said supple membrane.

The present invention relates to a process for controlling the opening of an injection valve for injecting a carburetted mixture into an engine as defined above, which consists in controlling the opening of said valve as soon as possible when the pressure $P_B$ in a chamber-pump crankcase connection becomes lower than the pressure $P_S$ in a capacity.

BRIEF DESCRIPTION OF THE DRAWINGS

Other features, advantages and embodiments of the present invention will be clear from reading the description hereafter, given by way of non limitative examples, with reference to the accompanying drawings in which.

DESCRIPTION OF THE PREFERRED EMBODIMENTS

Figure 1:
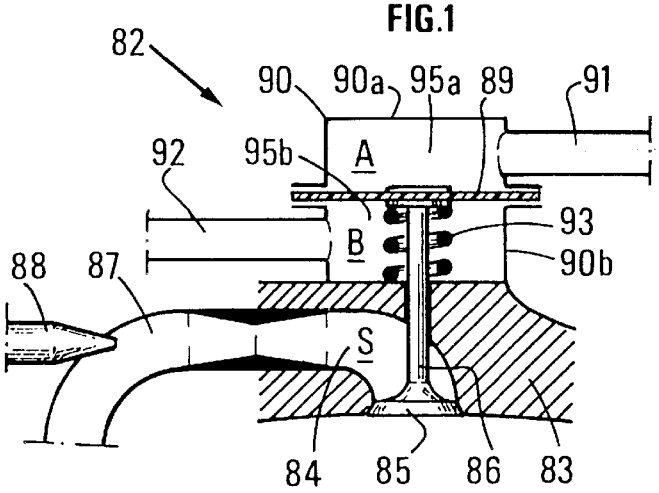
FIG. 1 is a cutaway view of an assisted valve that can work according to the invention.

FIG. 1 shows a device intended for controlling the injection in a cylinder of a two-stroke engine, indicated in a general way by reference number 82.

Figure 2:
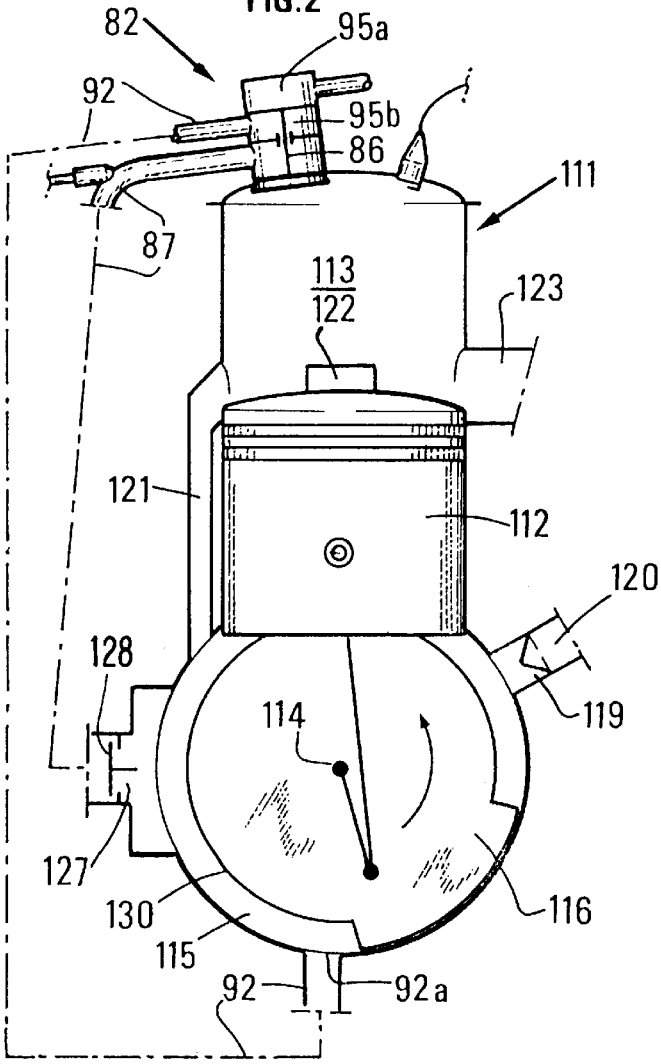
FIG. 2 is a simplified longitudinal section of a cylinder of a two-stroke engine according to an embodiment of the invention.
Figure 4:
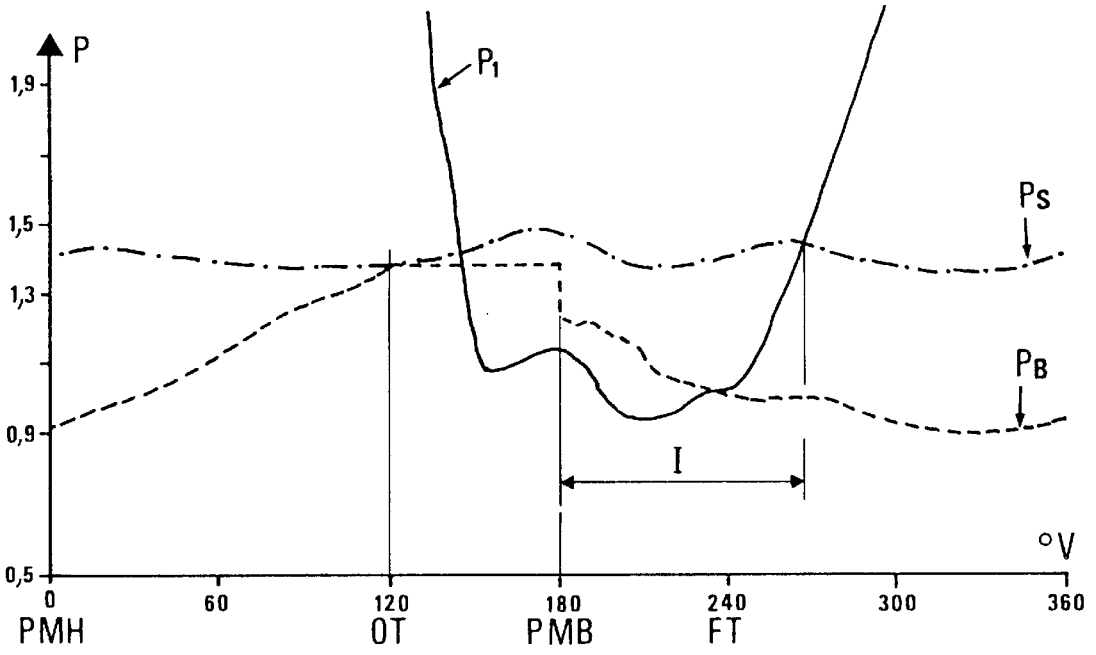
FIG. 4 is a diagram showing the different control pressures of a valve according to another embodiment of the invention, as a function of the angle of rotation of the crankshaft.

Such an assisted automatic valve type injection device can notably be associated with each of the cylinders of a two-stroke engine such as that shown in FIGS. 2 and 4.

In FIGS. 2 and 4, it can be seen that the assisted automatic valve injection device 82 is fastened to the cylinder head of the engine at the level of the corresponding cylinder.

As can be seen in FIG. 1, the injection device 82 comprises a carburetted air (or gas) supply line 84 machined in cylinder head 83 which opens, through an opening 85, into the inner volume of the cylinder. Line 84 is connected to a pipe 87 into which opens the end of a fuel proportioning and/or injection means 88.

The valve 86 intended for closing the end of line 84 opening into the is cylinder comprises a head that rests, in the closed position of the valve as shown in FIG. 1, into the opening 85 forming a valve seat. The rod (not referenced) of valve 86 is connected at its other end to a supple membrane 89 tightly fastened over its entire periphery between two parts of the wall of a housing 90 of the injection means 82.

Housing 90 preferably consists of an upper hollow half shell 90*a* and of a lower half shell 90*b* connected together and to the periphery of membrane 89 by means of external edges forming mounting flanges for housing 90.

The upper part 90*a* of housing 90 comprises a pipe 91 opening into its inner volume and the lower part 90*b* of housing 90, which is tightly fastened to the cylinder head 83 above the opening 85 of line 84, comprises a pipe 92 opening into its inner volume.

A return spring 93 is preferably inserted between the supple membrane 89 or the end of the rod of valve 86 and the upper surface of cylinder head 83.

An assisted valve injection device such as that shown in FIG. 1 is known from the prior art and allows to control the opening and the closing of the valve which determines the beginning and the end of the injection in the cylinder, by adjustment of the differential pressure between the chambers 95*a* and 95*b* delimited in housing 90 by membrane 89.

To that effect, pipes 91 and 92 can be connected to controlled pressure gas supply devices allowing to ensure the opening or the closing of valve 86 by differential pressure in chambers 95*a* and 95*b*, and by differential pressure between chamber 84 and the cylinder.

According to the invention, in the case of an air-blast injection two-stroke engine having one or several cylinders, the control pressure in at least one of the chambers 95*a* and 95*b* is produced by communicating this chamber with the inner volume of the pump crankcase of the same cylinder of the engine.

FIG. 2 shows an embodiment of the invention where the injection device 82 is part of an engine one cylinder 111 of which is shown in a longitudinal section.

Conventionally, cylinder 111 comprises a combustion chamber 113 in which moves a piston 112 communicating in its lower part with a pump crankcase 115.

Pump crankcase 115 conventionally comprises an air supply nozzle 119 provided with a clapper valve 120.

The fresh air introduced into crankcase 115 and compressed by piston 112 is injected into the combustion chamber 113 of cylinder 111, by means of transfer lines such as lines 121 that open into the cylinder chamber through openings 122. The burned gases are discharged from chamber 113 through a pipe 123.

According to the invention, pipe 87 is placed under pressure either by means of an external source, or by the fact that this pipe opens, at its end 127 opposite that opening into the injection device 82, directly into pump crankcase 115.

Opening 127 is preferably controlled by a nonreturn valve 128 or by any other means capable of sealing this opening as soon as the pressure in the pump crankcase 115 becomes lower than the pressure in pipe 87, which is thus used as a pressure storage capacity.

Furthermore, pipe 92, which communicates through one of its ends with the chamber 95*b* of the injection device 82, opens, according to the invention, into the pump crankcase 115 through its other end. The pressure $P_B$ in chamber 95*b* therefore follows the pressure variations in the pump crankcase 115 of cylinder 111.

According to a first embodiment of the invention, the pressure $P_A$ in chamber 95*a* can be the atmospheric pressure or another rather constant pressure.

The running of the injection device according to the invention will now be described hereunder in connection with FIG. 3 which shows, as a function of the angle of rotation of the crankshaft, the variations in:

- the pressure P1 in cylinder 111, this pressure being represented in full line,
- the pressure $P_S$ in the capacity 87 and in chamber 84, this pressure being represented in dot-and-dash line,
- the pressure $P_B$ in the pump crankcase 115, the pipe 92 and the chamber 95*b*, this pressure being represented in dotted line.

According to this embodiment of the invention, from the top dead center (TDC zero crankshaft angle) to the neighbourhood (OT) of the opening of the transfer ports, the cylinder pressure P1 is always higher than the pressure $P_S$ in capacity 87. Therefore, valve 86 does not open.

From the time when the cylinder pressure P1 becomes lower than the pressure $P_S$, valve 86 should open if the engine was not in accordance with the invention. This would thus imply an opening of the valve and an injection start as soon as the transfer ports open, i.e. very early in the cycle.

The presence of the pipe 92 according to the invention allows chamber 95*b* to remain at a pressure $P_B$ higher than the pressure $P_S$ for about 30° crankshaft.

The effect of the pressure $P_B$ will then be predominant in relation to that of pressure $P_S$ (if the sections of membrane 89 and of valve 89 are considered equivalent).

With such a dimensioning, the opening of valve 86 will thus be delayed at least until the crankcase pressure $P_B$ becomes lower than the capacity pressure $P_S$.

If membrane 89 has a greater section, the opening of the valve will be delayed still more.

Figure 3:
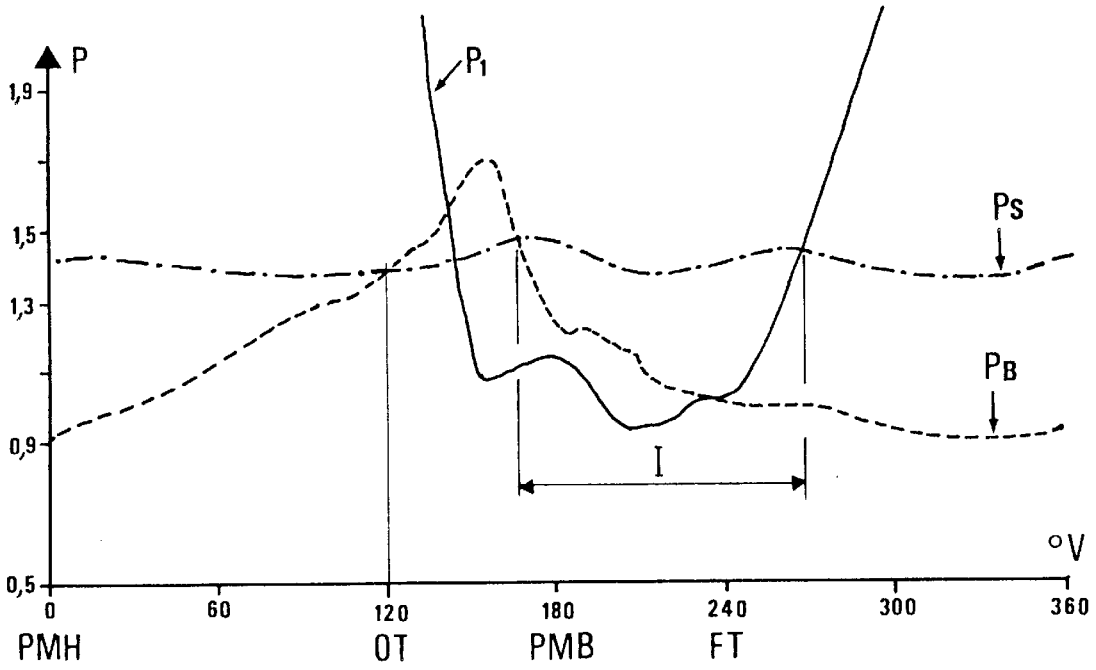
FIG. 3 is a diagram showing the different control pressures of a valve according to a first embodiment of the invention, as a function of the angle of rotation of the crankshaft.

The injection I thus starts according to this configuration and under the engine running conditions of FIG. 3, at about 165° crankshaft, and it ends when the cylinder pressure P1 becomes higher than the capacity pressure $P_S$, i.e. in the region of 270° crankshaft.

The invention thus allows to delay significantly the beginning of the carburetted mixture injection in a simple and reliable manner. The running of the engine is improved since said delay allows to limit the unburned fuel that is directly discharged in the exhaust.

FIG. 2 moreover shows a flange 116 linked to the crankshaft. This element, which is not necessarily present in the pump crankcase 115, nevertheless allows the following additional characteristic to be obtained: a selective sealing of connection 92.

In fact, flange 116 is cut-out on its periphery, so that only a given angular sector seals the port 92*a* of connection 92, therefore for a given angular range of an engine cycle.

As can be seen in FIG. 4, the pressure $P_B$ in pipe 92 and in chamber 95*b* is stored at a given value taken prior to the pressure drop in the pump crankcase, i.e. taken for example at the time of the opening of the transfer ports OT. Flange 116 allows here to close port 92*a* until the desired time for activating the opening of the valve, i.e. for example the point PMB (=BDC) in FIG. 4.

The selective sealing of pipe 92 thus allows to store the crankcase pressure $P_B$ for a time that is determined by the value of the angular sector of flange 116.

The valve opening delay is here greater than in the previous case since the opening starts in the region of 180° crankshaft, whereas in the previous case (without the flange) this opening occurred in the region of 165° crankshaft. It should be reminded that, without the invention, the valve opens when the pressure in the cylinder becomes lower than the pressure in pipe 87, i.e. in the case considered, in the region of 130° crankshaft.

Furthermore, the flange 116 according to the invention allows to control better the opening of valve 86 since, as can be seen notably in FIG. 4, pipe 92 opens wide and the pressure consequently drops totally, so that the opening is also better controlled since it no longer depends on the pressure decrease in the pump crankcase, a decrease that is not always so fast according to the charging conditions and to the speed of the engine. According to this embodiment of the invention, the opening of the valve simply depends on the opening of pipe 92 by flange 116.

Another improvement of the present invention can consist in communicating intermittently chamber 95*a* with pump crankcase 115.

Figure 5:
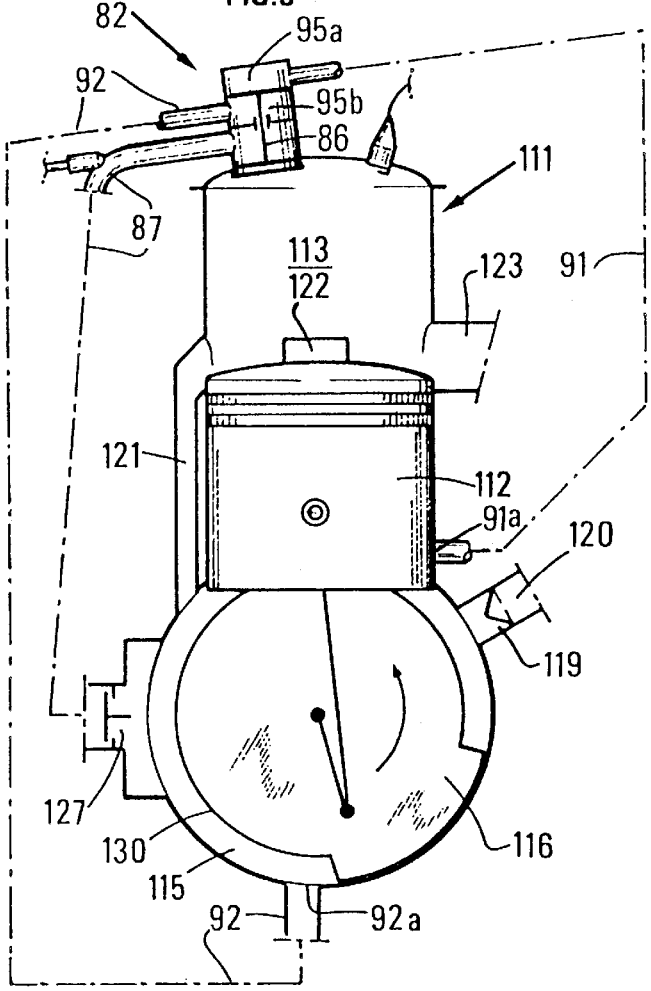
FIG. 5 is a simplified longitudinal section of a cylinder of a two-stroke engine according to yet another embodiment of the invention.
Figure 6:
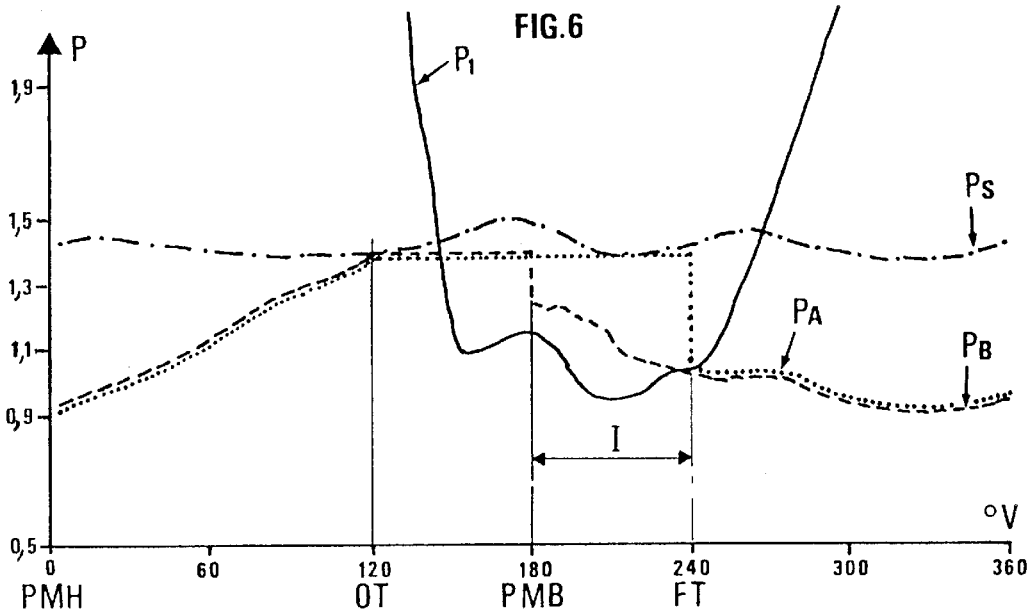
FIG. 6 is a diagram showing the different control pressures of a valve in an engine according to FIG. 5, as a function of the angle of rotation of the crankshaft.

As explained in detail hereafter, in connection with FIGS. 5 and 6, such an embodiment of the invention allows notably to obtain a faster opening through an amplification of the motion of the valve, as well as an improved closing of the valve. In fact, in the previous embodiments, a certain inertia of the automatic valve has sometimes been observed, which slows down its opening.

FIG. 5 thus shows an embodiment similar to the previous ones, but in which the engine also comprises a connection 91 between chamber 95*a* and pump crankcase 115.

Connection 91 preferably opens, through a port 91*a* located in the lower part of the cylinder, just above the pump crankcase. Connection 91 is thus communicated with the pump crankcase when piston 112 moves above said port 91*a*, i.e. intermittently.

Connection 91, which is thus controlled by the piston skirt, can be closed from the opening of the transfer ports 122 to the closing of these ports, i.e. symmetrcially with respect to the bottom dead center.

Without departing from the scope of the invention, another phasing can be obtained, for example a non-symmetrical opening and closing with respect to the bottom dead center, by means of a flange linked to the crankshaft. This flange can be or not the same as that which controls connection 92.

FIG. 6 illustrates the procedure of this embodiment of the invention.

The pressure $P_A$ in chamber 95*a* and the pressure $P_B$ in chamber 95*b* remain both equal to the pressure in the pump crankcase until the opening of the transfer ports OT. Valve 86 is then kept on its seat through the difference between the pressure P1 in cylinder 113 and the pressure $P_S$ in capacity 87, possibly with the aid of a return spring.

Port 91*a* is then closed by the piston.

Port 92*a* can possibly be closed simultaneously by flange 116, as shown in FIG. 6, but this is not obligatory.

The valve opening command starts as soon as the pressure $P_B$ becomes lower than the pressure $P_S$ in the capacity. The drop of pressure $P_B$ can occur either naturally, i.e. without flange 116, or at the opening of port 92*a* by flange 116.

At this time, the pressure $P_A$ that becomes higher than the pressure $P_B$ allows to amplify the force necessary for opening the valve with an appropriate ratio between the surface of membrane 89 and that of valve 86. The opening of valve 86 is therefore faster and its amplitude can also be increased by means of this effect.

Besides, when port 91*a* is uncovered by the piston (in the neighbourhood of the closing of the transfert ports FT in FIG. 6), the pressure $P_A$ in chamber 91*a* drops suddenly, which activates the closing of valve 86, in view of the pressure differences P1, $P_A$, $P_B \cdot P_A$ and $P_B$ follow from then on the variations in the pressure in the pump crankcase, a pressure that is markedly lower than the pressure P1 in the cylinder.

As stated above, the rod of the valve can be equipped with a calibrated return spring 93. This spring will be selected stiffer in the last configuration because the force necessary for opening the valve is then greater than in the previous cases.

The high stiffness of spring 93 will help towards the closing, which is facilitated thereby.

It is possible, according to this embodiment of the invention, to limit the travel of the valve by appropriate means such as stop rings (not shown).

I claim:

1. A two-stroke engine comprising at least:

a cylinder in which a piston moves and one end of which communicates with a pump crankcase crossed through by the crankshaft of the engine, a capacity under pressure opening at one end into the combustion chamber of the cylinder, and opening at its other end into the pump crankcase of said cylinder, a non-return valve controlling the opening of the capacity at the level of the pump crankcase of the cylinder, at least one valve ensuring an intermittent sealing between the chamber and the capacity, a means for carburetting the gas passing in said capacity, a means for controlling the opening of said valve comprising a supple membrane separating two chambers and connected to the rod of the valve, and a linking means between one of said chambers and the pump crankcase of said cylinder, allowing notably the opening of the valve to be activated as soon as possible when the pressure $P_B$ in said one chamber becomes lower than the pressure $P_s$ in said capacity, the pressure $P_1$ in the cylinder being then lower than the pressure $P_s$ in the capacity.

2. An engine as claimed in claim 1, wherein the engine is comprised of only a single cylinder.

3. An engine as claimed in claim 1, wherein the engine comprises a plurality of juxtaposed autonomous cylinders.

4. An engine as claimed in claim 1, characterized in that it also comprises an elastic return element for replacing valve onto its seat, which co-operates with said supple membrane.

5. An engine as claimed in claim 1, characterized in that it also comprises a stop ring for limiting the opening amplitude of valve.

6. A process for controlling the opening of a carburetted mixture injection valve in an internal-combustion engine as claimed in claim 1, characterized in that it consists in controlling said opening as soon as possible when the pressure $P_B$ in the connection becomes lower than the pressure $P_S$ in the capacity.

7. An engine as claimed in claim 1, characterized in that it also comprises a means for sealing intermittently said linking means as to delay the pressure drop in the linking means, i.e. the opening of valve.

8. An engine as claimed in claim 7, characterized in that said intermittent sealing means comprises a flange located in the pump crankcase, linked in rotation to the crankshaft of the engine and comprising at least a peripheral recess.

9. An engine as claimed in claim 8, characterized in that said control means comprise a means of connection between the other one of said chambers and said pump crankcase, said control means being so laid out that it is sealed intermittently on the pump crankcase side, said control means allowing alternately to amplify the opening of the valve and to help towards its closing.

10. An engine as claimed in claim 1, characterized in that it also comprises control means linked to the closing of the valve.

11. An engine as claimed in claim 10, characterized in that said connection means opens through an opening into the lower part of the cylinder so as to be alternately covered and uncovered by the piston.

12. An engine as claimed in claim 10, characterized in that the intermittent sealing of the connection means is achieved by a specific flange linked to the crankshaft.

* * * * *